US011577306B2

(12) United States Patent
Takaya et al.

(10) Patent No.: US 11,577,306 B2
(45) Date of Patent: Feb. 14, 2023

(54) CONTINUOUS CASTING METHOD FOR STEEL

(71) Applicant: NIPPON STEEL CORPORATION, Tokyo (JP)

(72) Inventors: Shin Takaya, Tokyo (JP); Toshihiko Murakami, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 0 days.

(21) Appl. No.: 17/291,028

(22) PCT Filed: Dec. 10, 2019

(86) PCT No.: PCT/JP2019/048269
§ 371 (c)(1),
(2) Date: May 4, 2021

(87) PCT Pub. No.: WO2020/122061
PCT Pub. Date: Jun. 18, 2020

(65) Prior Publication Data

US 2021/0387248 A1 Dec. 16, 2021

(30) Foreign Application Priority Data

Dec. 10, 2018 (JP) ..... JP2018-231136

(51) Int. Cl.
*B22D 11/124* (2006.01)
*B22D 11/22* (2006.01)

(52) U.S. Cl.
CPC ..... *B22D 11/1245* (2013.01); *B22D 11/1246* (2013.01); *B22D 11/22* (2013.01)

(58) Field of Classification Search
CPC ..... B22D 11/124; B22D 11/1245; B22D 11/1246; B22D 11/22
USPC ..... 164/486, 487, 444
See application file for complete search history.

(56) References Cited

U.S. PATENT DOCUMENTS 4,424,855 A * 1/1984 Tsubakihara et al. ..... B22D 11/1246 164/455

FOREIGN PATENT DOCUMENTS

| | | | | |
|---|---|---|---|---|
| EP | 2 937 162 A1 * | 10/2015 | ..... | B22D 11/124 |
| JP | 2010-253525 A | 11/2010 | | |
| JP | 2018-99704 A | 6/2018 | | |

* cited by examiner

*Primary Examiner* — Kevin P Kerns
(74) *Attorney, Agent, or Firm* — Myers Wolin, LLC

(57) ABSTRACT

In a first cooling zone (21) on an upper side of a vertical section (20), an air-water ratio $A_1/R_1$ defined by an amount of water $R_1$ (L/min) and an amount of air $A_1$ (L/min) per one cooling spray nozzle is set to 10 or more, an impinging pressure of cooling water colliding with the surface of a slab (1) from the cooling spray nozzle is set to 12 gf/cm$^2$ or more, a cooling intensity $W_1 \times t_1$ defined by a cooling water density ($W_1$) (L/min/m$^2$) and a passing time $t_1$ (min) of the first cooling zone (21) is 350 or more, and a recuperating time from having passed through the first cooling zone (21) until reaching a bent section (30) is set to 0.5 min or more.

6 Claims, 1 Drawing Sheet

CONTINUOUS CASTING METHOD FOR STEEL

CROSS-REFERENCE TO RELATED APPLICATION

This application is a national stage application of International Application No. PCT/JP2019/048269, filed on Dec. 10, 2019 and designated the U.S., which claims priority to Japanese Patent Application No. 2018-231136, filed on Dec. 10, 2018. The contents of each are herein incorporated by reference.

TECHNICAL FIELD

The present disclosure relates to a continuous casting method for steel.

Priority is claimed on Japanese Patent Application No. 2018-231136, filed Dec. 10, 2018, the content of which is incorporated herein by reference.

BACKGROUND ART

In recent years, in steel materials such as thick steel sheets, many low alloy steels containing alloy elements such as Ti, Nb, Ni, and Cu have been produced to improve mechanical properties. However, surface crack defects occur in the slabs produced in continuous casting with the addition of these alloy elements, which leads to a problem in terms of operation and product quality. The surface cracks mentioned herein have a meaning of a general term for crack forms such as lateral cracks which are not directed in a casting direction.

Examples of a method for preventing cracks in the surface of a slab containing an alloy element in continuous casting include a method as disclosed in Patent Document 1. The method disclosed in Patent Document 1 is for performing casting with a surface temperature of a slab at a bent section or a straightened portion set to be higher than an embrittlement temperature range by increasing an average water amount density for a water cooling nozzle directly under a casting mold and spraying cooling water onto the slab at a prescribed impinging pressure and stably cooling a surface temperature of the slab to an $A_3$ transformation temperature or less while peeling off powder adhering to the surface of the slab and then recuperating the slab.

It is known that cracks on a surface occurring subsequent to a secondary cooling zone of continuous casting are cracks occurring along the old austenite grain boundaries on the surface layer of a slab. Such cracks may occur when stress is concentrated on austenite grain boundaries embrittled through precipitation of AlN, NbC, and the like and the film-like ferrite generated along the old austenite grain boundaries. The forms of the cracks differ in accordance with directions of such stress and the lateral cracks are caused by tensile stress in a casting direction. Particularly, cracks easily occur in a temperature range in the vicinity of a region of phase transformation from austenite to ferrite. Therefore, as disclosed in Patent Document 1, a method is adopted in which occurrence of cracks is minimized by causing a surface temperature in a bent or straightened band in which mechanical stress is applied to the surface of the slab not to be within a temperature range (an embrittlement temperature range) in which ductility is reduced.

CITATION LIST

Patent Document

[Patent Document 1]
Japanese Unexamined Patent Application, First Publication No. 2018-099704

SUMMARY

Problems to be Solved

In recent years, as the number of alloy steel grades to which various elements are added to improve mechanical properties has increased, the number of steel grades with a high sensitivity to surface cracking of slabs has increased and it is not necessarily possible to prevent occurrence of cracks in the surface of slabs simply using the above-described continuous casting method in which the surface temperature is not within the embrittlement temperature range. In this way, in the continuous casting method for steel in the related art, there is room for improvement in view of preventing cracks in the surface of a slab while ensuring a desired cooling capacity.

The present disclosure was made in view of the above circumstances, and an object of the present disclosure is to provide a continuous casting method for steel in which a microstructure of a surface layer of a slab can be controlled, cracks in the surface of the slab caused by secondary cooling non-uniformity can be controlled, and cracks in the surface of the slab caused by strain at a bent section can be minimized.

Means for Solving the Problem (1) A continuous casting method for steel according to an aspect of the present disclosure is a continuous casting method for steel using a vertical bent type continuous casting device which includes a vertical section configured to pull out a slab from a casting mold downward in a vertical direction, a bent section in which the slab pulled out from the vertical section is bent, and a first cooling zone including rolls and cooling spray nozzles in the vertical section, in which, in the first cooling zone, an air-water ratio $A_1/R_1$ which is a ratio of an amount of air $A_1$ (L/min) to an amount of water $R_1$ (L/min) per one of the cooling spray nozzles is set to 10 or more and an impinging pressure of cooling water colliding with a surface of the slab through the cooling spray nozzles is set to 12 gf/cm$^2$ or more, a cooling intensity $W_1 \times t_1$ defined as a product of a cooling water density $W_1$ (L/min/m$^2$) in the first cooling zone and a time $t_1$ (min) during which the slab passes through the first cooling zone is set to 350 or more, and a recuperating time $t_2$ of the slab from having passed through the first cooling zone until reaching the bent section is set to 0.5 min or more.

(2) In the continuous casting method for steel according to (1), in the first cooling zone, the amount of water $R_1$ (L/min) per one of the cooling spray nozzles may be set to 20 L/min or more and 50 L/min or less.

(3) In the continuous casting method for steel according to (1) or (2), in the first cooling zone, the cooling water density $W_1$ (L/min/m$^2$) may be set to 500 L/min/m$^2$ or more and 2000 L/min/m$^2$ or less.

(4) In the continuous casting method for steel according to any one of (1) to (3), the vertical bent type continuous casting device may include a second cooling zone between the first cooling zone and the bent section, and in the second cooling zone, the surface of the slab may be recuperated by setting the cooling water density $W_2$ (L/min/m$^2$) to 0 L/min/m$^2$ or more and 50 L/min/m$^2$ or less.

(5) In the continuous casting method for steel according to any one of (1) to (4), the surface of the slab may be recuperated after having passed through the first cooling zone and a temperature of the surface of the slab may be set to a temperature of an $Ac_3$ point or higher when the slab reaches the bent section.

(6) In the continuous casting method for steel according to any one of (1) to (5), the rolls may be split rolls.

Effects

In a continuous casting method for steel of the present disclosure, a slab is cooled using mist spraying with a high air-water ratio and a high impinging in a first cooling zone provided in a vertical section. It is conceivable that, when mist spraying with a high air-water ratio and a high impinging pressure is utilized for spraying of mist, it is possible to peel off mold powder on the surface of a slab, it is possible to minimize occurrence of accumulated water between rolls, and it is possible to subject a slab to uniform secondary cooling.

Also, in a continuous casting method for steel of the present disclosure, a cooling intensity in a first cooling zone is increased to a prescribed value or more. It is conceivable that it is possible to more appropriately control a microstructure of a surface layer of a slab by setting the cooling intensity to a prescribed value or more.

In addition, in a continuous casting method for steel of the present disclosure, it is possible to cool a slab using a first cooling zone and then appropriately recuperate the surface of the slab by setting a recuperating time at which the slab reaches a bent section to a prescribed value or more. Thus, it is possible to generate a fine structure in the surface of the slab and minimize cracks in the surface of the slab in the bent section.

As described above, according to a continuous casting method for steel of the present disclosure, it is possible to control a microstructure of a surface layer of a slab, to minimize cracks in the surface of the slab caused by secondary cooling non-uniformity, and minimize cracks in the surface of the slab caused by strain in a bent section.

Figure 1:
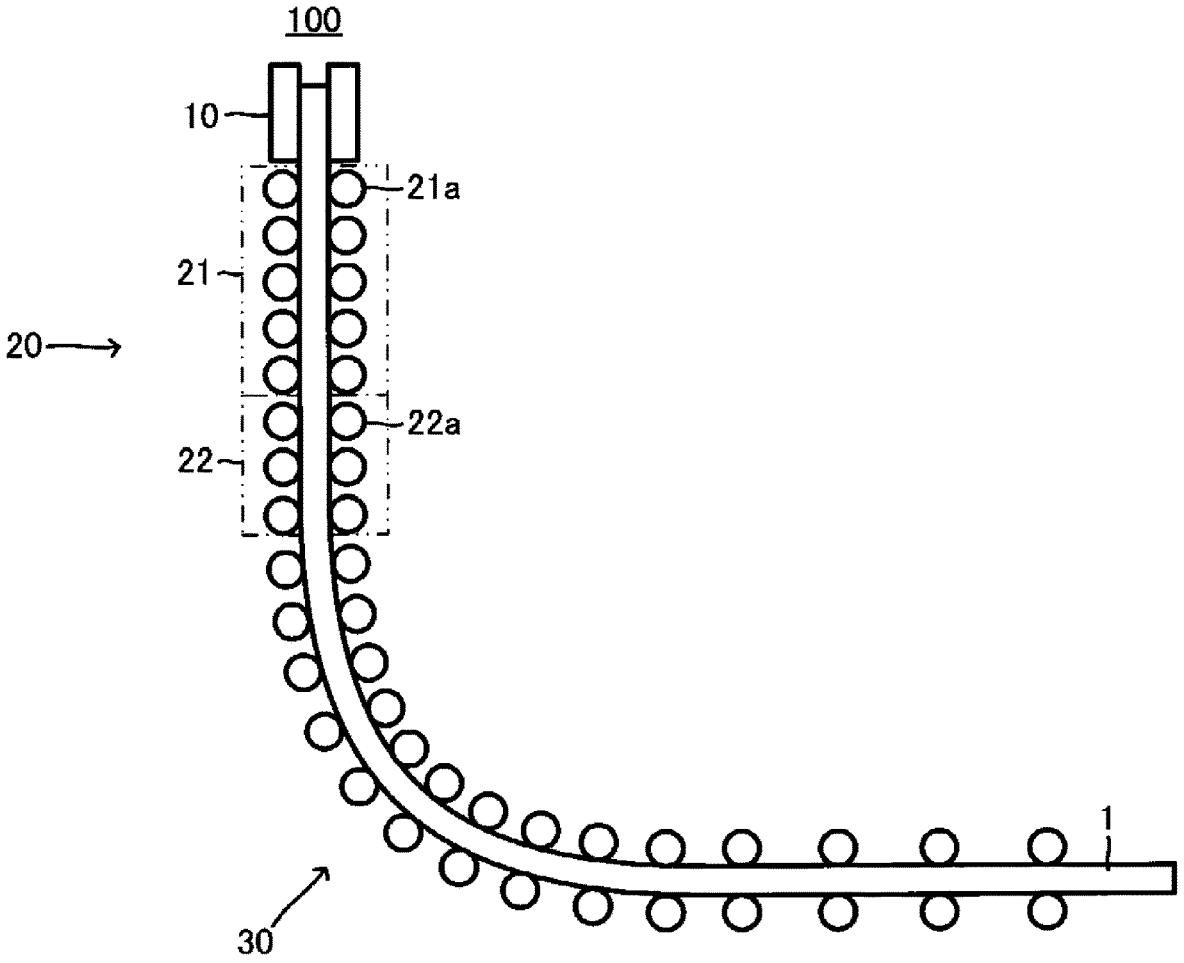
FIG. 1 is a schematic diagram for explaining a continuous casting method for steel of the present disclosure.

An embodiment of the present disclosure be described in detail below with reference to the drawings. In this specification and the drawings, constituent elements having substantially the same functional constitution will be denoted by the same reference numerals and duplicate description thereof will be omitted.

In this specification, a numerical range represented using the word "to" refers to a range including numerical values stated before and after the word "to" as a lower limit value and an upper limit value. In this specification, the term "process" is used not only to mean an independent process and also includes a process which cannot be clearly distinguished from other processes as long as an intended purpose of the process is achieved. Furthermore, it is obvious that constituent elements of the following embodiments can be combined.

DETAILED DESCRIPTION

Figure 2:
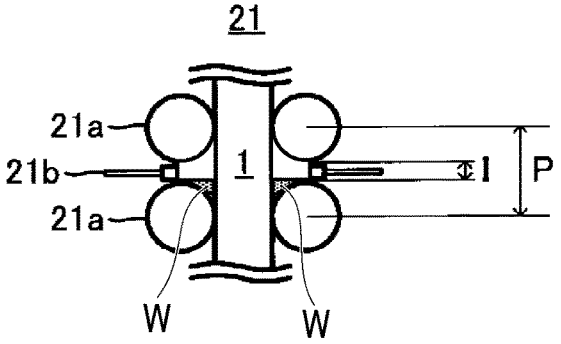
FIG. 2 is an enlarged and schematic diagram of a part of a first cooling zone 21 of FIG. 1.

A continuous casting method for steel of the present disclosure will be described with reference to FIG. 1. FIG. 1 is a diagram schematically illustrating a positional relationship between a casting mold 10, a vertical section 20, a bent section 30, and the like in a vertical bent type continuous casting device 100. In FIG. 1A, cooling spray nozzles and the like will be omitted for the sake of clarity. FIG. 2 is an enlarged and schematic diagram of a part of a first cooling zone 21 of the vertical section 20 and schematically illustrates a positional relationship between rolls 21*a* and cooling spray nozzles 21*b*. As illustrated in FIG. 2, cooling water discharged through the cooling spray nozzles 21*b* remains as accumulated water W between a slab 1 and the rolls 21*a* in accordance with the conditions such as an amount of the cooling water.

The continuous casting method for steel in this embodiment is a method for continuously casting steel using a vertical bent type continuous casting device 100 which includes the vertical section 20 configured to pull out the slab 1 from the casting mold 10 downward in a vertical direction, the bent section 30 in which the slab 1 pulled out from the vertical section 20 is bent, and the first cooling zone 21 including the rolls 21*a* and the cooling spray nozzles 21*b* in the vertical section 20, in which, in the first cooling zone 21, an air-water ratio $A_1/R_1$ which is a ratio of an amount of air $A_1$ (L/min) to an amount of water $R_1$ (L/min) per one of the cooling spray nozzles 21*b* is set to 10 or more, the impinging pressure of cooling water colliding with a surface of the slab 1 from the cooling spray nozzles 21*b* is set to 12 gf/cm$^2$ or more, a cooling intensity $W_1 \times t_1$ defined as a product of a cooling water density $W_1$ (L/min/m$^2$) in the first cooling zone 21 and a time $t_1$ (min) at which the slab 1 passes through the first cooling zone 21 is set to 350 or more, and a recuperating time $t_2$ of the slab 1 from having passed through the first cooling zone 21 until reaching the bent section 30 is set to 0.5 min or more.

(Configuration of Continuous Casting Device 100)

The continuous casting method according to this embodiment is preferably utilized in a known vertical bent type continuous casting device. The casting mold 10 has a cross-sectional shape corresponding to a shape of the slab 1 which is a casting target. The vertical section 20 is provided immediately below the casting mold 10 and the bent section 30 is provided immediately below the vertical section 20.

A height of the vertical section 20 (a distance from a portion immediately below the casting mold 10 to the bent section 30) can be set to, for example, 0.5 m or more 3.0 m or less. The first cooling zone 21 is provided on at least an upper side of the vertical section 20. The first cooling zone 21 is configured to include the rolls 21*a* and the cooling spray nozzles 21*b*. In the first cooling zone 21, the number of rolls 21*a* configured to support one surface side of the slab 1 is not limited to the 5 as illustrated in FIG. 1. For example, the number of rolls 21*a* may be 1 or more and 7 or less. More preferably, the number of rolls 21*a* is 6 or less on one surface side (a total of 12 or less on one surface side and the other surface side). That is, the number of cooling stages in the first cooling zone is not limited to the 5 stages as illustrated in FIG. 1 and is preferably 6 stages or less.

In the first cooling zone 21, a roll pitch (P in FIG. 2) between rolls 21*a* adjacent to each other in a casting direction can be, for example, 50 mm or more and 300 mm or less and an interval (I in FIG. 2) between the rolls can be, for example, 10 mm or more and 100 mm or less. In the first cooling zone 21, the cooling spray nozzle 21*b* is provided between the casting mold 10 and the roll 21*a* immediately below the casting mold and/or between rolls 21*a* adjacent to each other in the casting direction and cooling water is sprayed onto a surface of the slab 1 through the cooling spray nozzles 21*b*. The number of cooling spray nozzles 21*b* between the rolls 21*a* is, for example, one in the casting direction and at least one in a slab width direction.

The vertical section 20 may include a second cooling zone 22 between the first cooling zone 21 and the bent section 30 (immediately below the first cooling zone 21). In the second cooling zone 22, the number of rolls 22*a* configured to support one surface side of the slab 1 can be, for example, 0 or more and 10 or less. In the second cooling zone 22, cooling spray nozzles (not shown) may be disposed between the roll 21*a* and the roll 22*a* or between rolls 22*a* adjacent to each other in the casting direction. In addition, in this case, the number of cooling spray nozzles between the rolls 22*a* can be, for example, one in the casting direction and at least one in the slab width direction.

Each of the rolls 21*a* may be a split roll. A split roll means a roll in which a surface of the roll is split into two or more surfaces in a direction along a shaft of the roll. The surface of the roll may be split into three surfaces, four surfaces, or five or more surfaces. The split roll has a shaft section having a diameter smaller than that of the surface of the roll between a plurality of split surfaces of the roll. When the roll 21*a* is not a split roll, both end portions of the roll are supported by bearing portions, but in the case of a split roll, a shaft section between the surfaces of the roll is supported by a bearing portion.

The vicinity of an end portion of the slab 1 is more easily cooled than a central portion of the slab 1 in a width direction thereof in which accumulated water easily occurs and cracks of a surface tend to easily occur in the vicinity of the end portion of the slab 1 due to a temperature difference of the slab 1 in the width direction thereof caused by this. When a split roll is utilized as the roll 21*a*, accumulated water is discharged from the shaft section between the plurality of surfaces of the roll. Thus, the temperature difference of the slab 1 in the width direction thereof decreases and it is possible to reduce cracking in the surface of the slab. Furthermore, when the roll is supported not only at both end portions of the roll 21*a* but also at the shaft portion at a center of the roll, it is possible to minimize bending of the roll also when a diameter of the roll is small.

A split roll may also be adopted for each of the rolls 22*a* for the same reason as in the roll 21*a* as described above.

The slab 1 which has passed through the vertical section 20 is bent and straightened in the bent section 30 and is conveyed in a horizontal direction. The "bent section" mentioned in the specification refers to a portion in which the casting direction of the slab 1 changes from the vertical direction to the horizontal direction. The bent section 30 may have the same configuration as that known in the art. Thus, here, a detailed description thereof will be omitted.

(Air-Water Ratio in First Cooling Zone 21)

In order to increase the impinging pressure of cooling water through the cooling spray nozzles 21*b*, it is effective to increase an amount of cooling water or to increase an amount of air in a state in which the amount of cooling water is secured. Here, when the amount of cooling water is simply increased, accumulated water in the roll 21*a* is easily generated. In order to increase the impinging pressure of cooling water while minimizing the amount of accumulated water, it is desirable to increase a ratio of the amount of air to the amount of cooling water (an air-water ratio). From this point of view, in the continuous casting method for steel in this embodiment, in the first cooling zone 21, an air-water ratio $A_1/R_1$ which is a ratio of an amount of air $A_1$ (L/min) to an amount of water $R_1$ (L/min) per cooling spray nozzle 21*b* is 10 or more. Although an upper limit of the air-water ratio is not particularly limited, the upper limit is preferably 100 or less in view of spray stability, and more preferably 50 or less.

(Amount of Water $R_1$ in First Cooling Zone 21)

The amount of water $R_1$ of the cooling spray nozzle 21*b* may be adjusted in consideration of the impinging pressure and a cooling intensity which will be described below. Particularly, in the continuous casting method for steel in this embodiment, in the first cooling zone 21, the amount of water $R_1$ (L/min) per cooling spray nozzle 21*b* is preferably 20 L/min or more and 50 L/min or less. Thereby, it is possible to more easily increase the impinging pressure of a spray while more easily minimizing occurrence of accumulated water.

(Impinging Pressure of Cooling Water in First Cooling Zone 21)

The inventors of the present disclosure have found that, when a high-temperature slab (for example, 950° C. or higher) is cooled using mist spraying, a cooling capacity (a heat transfer coefficient) has a good correlation with the impinging pressure of the spraying. This is because a heat transfer resistance of a boiling film acts predominantly in the heat transfer on the surface of the slab in a transition boiling region and thus, as the impinging pressure increases, the boiling film is physically pushed away and becomes thinner, resulting in an increase in the heat transfer coefficient. In addition, if the impinging pressure exceeds a certain level, mold powder adhering to the surface of the slab is peeled off and it is possible to reduce temperature unevenness in a width direction due to spray cooling. From this point of view, in the continuous casting method for steel in this embodiment, in the first cooling zone 21, the impinging pressure of cooling water colliding with a surface of the slab 1 through the cooling spray nozzles 21*b* is 12 gf/cm$^2$ or more, preferably 13 gf/cm$^2$ or more, more preferably 15 gf/cm$^2$ or more, and even more preferably 17 gf/cm$^2$ or more. On the other hand, there is a concern that, if the impinging pressure is too large, a solidified shell of the slab 1 will become partially recessed, cooling water will blow up from between the roll 21*a* and the slab 1, and there is a risk of breakout. From this point of view, in the continuous casting method for steel in this embodiment, the impinging pressure of cooling water colliding with a surface of the slab 1 from the cooling spray nozzles 21*b* is preferably 50 gf/cm$^2$ or less, more preferably 40 gf/cm$^2$ or less, and even more preferably 30 gf/cm$^2$ or less.

The impinging pressure of cooling water colliding with a surface of the slab 1 can be estimated, for example, through a method for performing measurement offline using a pressure receiving sensor or the following simple Expression 1:

$$Pc=10^{-2}\times W^{0.8}\times Va^{0.5}\times H^{-0.2}\times(A/R)^{-0.3} \quad \text{Expression 1}$$

In the foregoing Expression 1, Pc [gf/cm$^2$]: impinging pressure, W [L/min/m$^2$]: water amount density, Va [m/s]: pressurized air discharge flow rate (air flow rate [Nm$^3$/s]/air orifice area [m$^2$]), H[m]: spraying distance, A/R[–]: air-water ratio (volume ratio of air to water).

(Cooling Intensity in First Cooling Zone 21)

According to new findings of the inventors of the present disclosure, when a cooling intensity ($W_1\times t_1$) in the first cooling zone 21 is increased, it is possible to generate a fine structure in a surface layer of a slab and minimize the occurrence of cracks. It is thought that, when the cooling intensity is increased in the first cooling zone 21, it is possible to appropriately and quickly cool a surface of the slab to a temperature of an $Ar_3$ point or lower, which makes it easier to control a fine structure of the surface of the slab.

From this point of view, in the continuous casting method for steel in this embodiment, the cooling intensity $W_1 \times t_1$ defined as a product of a cooling water density $W_1$ (L/min/m$^2$) in the first cooling zone 21 and a time $t_1$ (min) at which the slab 1 passes through the first cooling zone 21 is set to 350 or more. An upper limit of the cooling intensity is not particularly limited, but is, for example, preferably 1500 or less, and more preferably 1200 or less.

The "cooling water density $W_1$" refers to an amount of cooling water to be sprayed (L) per unit time (min) per unit area (m$^2$) of the surface of the slab. For example, the "cooling water density $W_1$" can be defined as "an amount of water $R_1$ (L/min) per one cooling spray nozzle 21*b* split by a product of a roll pitch P (m) in the casting direction and a spray spraying width (m) in the slab width direction".

The cooling water density $W_1$ may be adjusted in consideration of the above-described air-water ratio, impinging pressure, and the like. Here, there is a concern that, in the first cooling zone 21, the vicinity of a corner to be cooled two-dimensionally may be easily supercooled, and particularly, when an amount of water is large, accumulated water in the roll may be easily generated, and secondary cooling of the surface of the slab may become non-uniform. On the other hand, when the amount of water is too small, it becomes difficult to achieve the above-described impinging pressure and the like. In this respect, in the continuous casting method for steel in this embodiment, in the first cooling zone 21, it is desirable that the cooling water density $W_1$ (L/min/m$^2$) be 500 L/min/m$^2$ or more and 2000 L/min/m$^2$ or less. A lower limit is more preferably 600 L/min/m$^2$ or more and an upper limit is more preferably 1750 L/min/m$^2$ or less.

(Recuperation from Passage of First Cooling Zone 21)

In the continuous casting method for steel in this embodiment, it is desirable that a surface of the slab 1 is recuperated after having passed through the first cooling zone 21 and a temperature of the surface of the slab 1 is set to a temperature of the $Ac_3$ point or higher when the slab 1 reaches the bent section 30. In order to realize this more easily, in the continuous casting method for steel in this embodiment, a recuperating time $t_2$ of the slab 1 from having passed through the first cooling zone 21 until reaching the bent section 30 is set to 0.5 min or more. When the recuperating time $t_2$ is set to 0.5 min or more, the surface of the slab which has been cooled to the temperature of the $Ar_3$ point or lower in the first cooling zone 21 is recuperated to a temperature of the $Ac_3$ point or higher due to sensible heat inside the slab, and the surface layer of the slab is stable and has a fine structure in which a y grain boundary is unclear. The upper limit of the recuperating time $t_2$ is not particularly limited, but is preferably 2.0 min or less, and more preferably 1.75 min or less.

(Others)

In the continuous casting method for steel in this embodiment, the vertical bent type continuous casting device 100 may include the second cooling zone 22 between the first cooling zone 21 and the bent section 30. Here, in the continuous casting method for steel in this embodiment, in the first cooling zone 21, it is desirable to cool the surface of the slab to a temperature of the $Ar_3$ point or lower and then to recuperate the surface of the slab to a temperature of the $Ac_3$ point or higher by adjusting the secondary cooling. In this case, it is necessary to pass the surface of the slab through the first cooling zone 21 with sufficient sensible heat inside the slab and complete the recuperation of the surface of the slab to the $Ac_3$ point to reach the bent section 30 to which mechanical strain is applied. Thus, in the second cooling zone 22, it is necessary to reduce a cooling water density as compared with the first cooling zone 21. To be specific, in the second cooling zone 22, it is desirable to recuperate the surface of the slab 1 by setting the cooling water density $W_2$ (L/min/m$^2$) to 0 L/min/m$^2$ or more and 50 L/min/m$^2$ or less.

In this specification, at the $A_3$ point of a temperature at which transformation is performed from a body-centered cubic lattice (a bcc ferrite) to a face-centered cubic lattice (fcc) of austenite, a temperature at which $A_3$ transformation (ferrite transformation) occurs during cooling is described as the $Ar_3$ point and a temperature at which $A_3$ transformation (austenite transformation) occurs during heating is described as the $Ac_3$ point.

As described above, in the continuous casting method for steel in this embodiment, when the slab 1 is cooled through mist spraying with a high air-water ratio and a high impinging pressure in the first cooling zone 21 provided on an upper side of the vertical section 20 which is a secondary cooling zone, it is possible to control a microstructure of the surface layer of the slab and prevent cracks in the surface of the slab caused by secondary cooling non-uniformity. Here, when steel is subjected to continuous casting using the vertical bent type continuous casting device 100, it is desirable to perform strong cooling immediately below the casting mold 10 to cool at least 2 mm from the surface of the slab to a temperature of the $Ar_3$ point or lower. After that, when the surface of the slab is recuperated to a temperature of the $Ac_3$ point or higher until the surface of the slab reaches the bent section 30, it is possible to more appropriately minimize cracks in the surface of the slab.

The cooling spray nozzle 21*b* installed in the first cooling zone 21 needs to be designed so that a large flow rate mist spray nozzle is provided and stable spraying can be obtained also at a high air-water ratio. Furthermore, in order to secure the impinging pressure, it is desirable that a distance from the slab 1 is short. To be specific, it is desirable that a distance (a spray height) from a surface of the slab 1 to the cooling spray nozzle 21*b* be 50 mm or more and 150 mm or less. If the distance is 50 mm or less, the distance between the cooling spray nozzle 21*b* and the slab 1 is short, the risk of nozzle clogging increases, and there is a concern of adverse effects on facility maintenance such as spray checks.

In the continuous casting method for steel in this embodiment, the conditions other than the above are not particularly limited. There is no particular limitation on a target steel grade. In view of obtaining a more remarkable effect, it is desirable to utilize a low alloy steel containing at least one alloy element of Ti, Nb, Ni, and Cu as a target. With regard to a casting rate, it is possible to handle both a low rate and a high rate. A casting rate Vc is preferably 500 mm/min or more and 3000 mm/min or less. In the continuous casting method in this embodiment, the casting conditions after the bent section 30 may be the same as in the related art. According to the continuous casting method for steel in this embodiment, for example, it is possible to manufacture a slab.

According to another embodiment of the present disclosure, a continuous casting device for steel in which the constituent elements of the above-described embodiment have been adopted is provided.

As described above, in the continuous casting method for steel in the present disclosure, in the first cooling zone 21 provided on the upper side of the vertical section 20, when the slab is cooled using mist spraying with a high air-water ratio and a high impinging, a cooling intensity in the first cooling zone 21 is increased to a prescribed value or more, and the recuperating time of the slab 1 until the slab reaches the bent section after the slab is cooled using the first cooling zone 21 is set to a prescribed value or more, it is possible to control a microstructure of the surface layer of the slab, minimize cracks in the surface of the slab caused by secondary cooling non-uniformity, and minimize cracks in the surface of the slab caused by strain in the bent section.

EXAMPLE

A continuous casting method for steel of the present disclosure will be described in more detail below with reference to examples.

1. Experimental Conditions

A slab with a width of 2200 mm and a thickness of 300 mm was manufactured using a vertical bent type continuous casting device. Steel grades had low alloy steel with a high crack susceptibility having compositions (mass %) as shown in Table 1.

$Ac_3$ point temperatures of steel grades A and B were 898° C. and 872° C.

TABLE 1

| | C | Si | Mn | P | S | Cu | Ni | Cr | Al | Nb | Ti | N |
|---|---|---|---|---|---|---|---|---|---|---|---|---|
| A | 0.06 | 0.5 | 1.6 | 0.01 | 0.004 | 0.25 | 0.35 | 0.02 | 0.02 | 0.015 | 0.001 | 0.004 |
| B | 0.12 | 0.2 | 1.2 | 0.008 | 0.003 | 0.30 | 0.08 | 0.3 | 0.03 | 0.015 | 0.015 | 0.004 |

In a secondary cooling zone in a continuous casting device, 15 mist spray nozzles per stage were installed for each 150 mm in the width direction between five-stage rolls from immediately below a casting mold to first to sixth rolls and an amount of cooling water in each stage could be controlled independently. This cooling zone was referred to as a "first cooling zone" and the experiment was conduct by appropriately changing an amount of water and an amount of air. In addition, the experiment was conducted by appropriately changing a shape of the rolls of the first cooling zone. A "split roll 1" was a split roll having one bearing portion with a size of 100 mm in the width direction, a "split roll 2" was a split roll having two bearing portions with a size of 100 mm in the width direction, and one roll was a roll in which the entire width of the slab and the roll come into contact with each other without a split portion.

In a cooling zone (a second cooling zone) from immediately below the first cooling zone to the bent section, as the cooling conditions in which a product of an average water amount density $W_2$ and a passing time $t_2$ was 0 to 50 ($L/m^2$), the slab was recuperated from having passed through the first cooling zone until reaching the bent section.

Table 2 below shows other casting conditions.

TABLE 2

| | |
|---|---|
| Slab size (width × thickness) | 2200 mm × 300 mm |
| First cooling zone Spray pitch | 150 mm |
| First cooling zone Spray height | 75 mm |
| First cooling zone Roll pitch | 200 mm |

2. Evaluation Conditions

With regard to an occurrence state of cracks in the surface of the slab, in a stationary section of each of the casting conditions, two full-width samples with a length of 100 mm in the casting direction were cut out in the casting direction, the surface of the slab was cleaned using an acid, and the total number of observed cracks of the surface with a length of 5 mm or more was evaluated as the "number of cracks". Furthermore, five samples for microscopic observation with 30 mm and a width of 50 mm were cut out from surface layers of the two samples in the width direction and a cast structure was also observed. The stationary section means a portion of the slab pull out at a target casting rate.

Table 3 below shows the details of the casting conditions and the evaluation results of the number of cracks in examples and comparative examples.

TABLE 3

| | Steel grade | Number of cooling stage | Shape of roll | Amount of water RI [L/min] | Amount of air Al [L/min] | Air-water ratio A1/R1 | Casting rate Vc [m/min] | Air flow rate Va [m/s] | Impinging pressure Pc [gf/cm²] | Water amount density W1 [L/min/m²] | Cooling time t1 [min] | Cooling intensity W1 × t1 | Recuperating time t2 [min] | Number of cracks [—] |
|---|---|---|---|---|---|---|---|---|---|---|---|---|---|---|
| Example 1 | A | 1 | Split roll 1 | 45 | 500 | 11 | 0.8 | 106 | 29 | 1500 | 0.25 | 375 | 1.75 | 0 |
| Example 2 | B | 2 | Split roll 1 | 30 | 400 | 13 | 1.0 | 85 | 18 | 1000 | 0.40 | 400 | 1.20 | 0 |
| Example 3 | A | 3 | Split roll 2 | 30 | 300 | 10 | 1.0 | 64 | 17 | 1000 | 0.60 | 600 | 1.00 | 0 |
| Example 4 | B | 5 | Split roll 1 | 35 | 500 | 14 | 1.0 | 106 | 22 | 1167 | 1.00 | 1167 | 0.60 | 0 |
| Example 5 | A | 5 | Split roll 2 | 30 | 350 | 12 | 1.2 | 74 | 17 | 1000 | 0.83 | 833 | 0.50 | 0 |
| Example 6 | B | 3 | Split roll 2 | 20 | 700 | 35 | 0.8 | 149 | 13 | 667 | 0.75 | 500 | 1.25 | 0 |
| Example 7 | A | 2 | One | 30 | 400 | 13 | 1.0 | 85 | 18 | 1000 | 0.40 | 400 | 1.20 | 3 |
| Example 8 | B | 4 | One | 25 | 700 | 28 | 1.2 | 149 | 16 | 833 | 0.67 | 556 | 0.67 | 2 |
| Example 9 | A | 4 | Split roll 2 | 52 | 600 | 12 | 1.2 | 127 | 35 | 1733 | 0.67 | 1156 | 0.67 | 4 |
| Example 10 | B | 5 | Split roll 2 | 18 | 1000 | 26 | 0.9 | 212 | 12 | 600 | 1.11 | 667 | 0.67 | 3 |
| Comparative Example 1 | A | 1 | Split roll 2 | 40 | 500 | 13 | 0.8 | 106 | 26 | 1333 | 0.25 | 333 | 1.75 | 27 |
| Comparative Example 2 | B | 6 | Split roll 1 | 20 | 600 | 30 | 1.0 | 127 | 12 | 667 | 1.20 | 800 | 0.40 | 38 |
| Comparative Example 3 | A | 5 | Split roll 2 | 30 | 200 | 7 | 1.1 | 42 | 16 | 1000 | 0.91 | 909 | 0.55 | 18 |

TABLE 3-continued

| | Steel grade | Number of cooling stage | Shape of roll | Amount of water RI [L/min] | Amount of air Al [L/min] | Air-water ratio A1/R1 | Casting rate Vc [m/min] | Air flow rate Va [m/s] | Impinging pressure Pc [gf/cm$^2$] | Water amount density W1 [L/min/m$^2$] | Cooling time t1 [min] | Cooling intensity W1 × t1 | Recuperating time t2 [min] | Number of cracks [—] |
|---|---|---|---|---|---|---|---|---|---|---|---|---|---|---|
| Comparative Example 4 | B | 3 | Split roll 1 | 20 | 400 | 20 | 0.9 | 85 | 11 | 667 | 0.67 | 444 | 1.11 | 22 |
| Comparative Example 5 | A | 2 | One | 20 | 300 | 15 | 0.7 | 64 | 10 | 667 | 0.57 | 381 | 1.71 | 35 |

As is clear from the results shown in Table 3, in Examples 1 to 6, there was no crack in surfaces as described above and in Examples 7 to 10, only shallow cracks in surfaces were observed and there was no problem. Furthermore, when a cross section of a surface layer was subjected to nital etching and observed through an optical microscope, it was confirmed that a structure composed of fine ferrite and perlite of 50 μm or less was uniformly formed in the width direction at least 2 mm from the surface.

In Examples 1 to 6, in the first cooling zone immediately below the casting mold, it is conceivable that it was possible to perform cooling with reduced accumulated water while peeling off powder adhering to the surface of the slab. Thus, it is conceivable that the surface layer of the slab could be stably cooled to a temperature of the $Ar_3$ point or lower also in the slab width direction, and then the temperature of the surface of the slab could be recuperated to a temperature of the $Ac_3$ point or higher until the surface of the slab reached the bent section and the surface of the slab could be controlled to have a structure in which cracks were difficult to occur.

In Examples 7 to 10, the fine structure of the surface layer had some unevenness and it was considered that the surface layer was affected by the accumulated water, which was conceivable to be the cause of the shallow cracks.

Also in any of Examples 1 to 10, it was confirmed that there was no powders or scale adhering to the surface of the slab and that these could be peeled off with sufficient impinging pressure.

On the other hand, in Comparative Example 1, a cooling intensity ($W_1 \times t_1$) was insufficient and many cracks in a surface of a slab occurred at a position in which a fine structure of a surface layer is 1 mm or less (a position in which a structure length of the slab in the thickness direction was 1 mm or less).

In Comparative Example 2, although a cooling intensity ($W_1 \times t_1$) was sufficient, a recuperating time ($t_2$) was short. Thus, it is conceivable that a large number of cracks in a surface occurred in a surface of a slab due to strain received in the bent section before a fine structure was generated in the surface of the slab. Particularly, remarkable cracks were observed in the vicinity of a corner cooled two-dimensionally.

In Comparative Example 3, although a cooling intensity ($W_1 \times t_1$) was sufficient, it is conceivable that an air-water ratio ($A_1/R_1$) was small and the discharge of accumulated water deteriorated. Thus, many cracks occurred non-uniformly in the width direction.

In Comparative Examples 4 and 5, the impinging pressure was insufficient and many non-uniform cracks occurred due to uneven cooling. Adhering powders and scale were also confirmed from a surface layer sample and it was found that sufficient impinging pressure was not applied to peel the powders and scale off.

From the above results, in order to prevent cracks in the surface of the slab occurred when steel is subjected to continuous casting using the vertical bent type continuous casting device, it can be said that it is effective to set the cooling conditions of the slab in the secondary cooling zone as follows.

(1) In the first cooling zone provided on the upper side of the vertical section, the air-water ratio $A_1/R_1$ which is the ratio of the amount of air $A_1$ (L/min) to the amount of water $R_1$ (L/min) per one cooling spray nozzle is set to 10 or more.

(2) In the first cooling zone, the impinging pressure of the cooling water colliding with the surface of the slab through the cooling spray nozzle is set to 12 gf/cm$^2$ or more.

(3) The cooling intensity $W_1 \times t_1$ defined as the product of the cooling water density $W_1$ (L/min/m$^2$) in the first cooling zone and the time $t_1$ (min) at which the slab passes through the first cooling zone is set to 350 or less.

(4) The recuperating time $t_2$ of the slab from having passed through the first cooling zone until reaching the bent section is set to 0.5 min or more.

INDUSTRIAL APPLICABILITY

Since the present disclosure can provide a continuous casting method for steel in which a microstructure of a surface layer of a slab can be controlled, cracks in the surface of the slab caused by secondary cooling non-uniformity can be minimized, and cracks in the surface of the slab caused by strain in a bent section can be minimized, an excellent industrial applicability is provided.

BRIEF DESCRIPTION OF THE REFERENCE SYMBOLS

1 Slab
10 Casting mold
20 Vertical section
21 First cooling zone
21*a* Roll
21*b* Cooling spray nozzle
22 Second cooling zone
22*a* Roll
30 Bent section
100 Continuous casting device

The invention claimed is:

1. A continuous casting method for steel using a vertical bent continuous casting device which includes a vertical section configured to pull out a slab from a casting mold downward in a vertical direction, a bent section in which the slab pulled out from the vertical section is bent, and a first cooling zone including rolls and cooling spray nozzles in the vertical section, the method comprising:

in the first cooling zone, setting an air-water ratio $A_1/R_1$ which is a ratio of an amount of air $A_1$ (L/min) to an amount of water $R_1$ (L/min) per one of the cooling spray nozzles to 10 or more and setting an impinging pressure of cooling water colliding with a surface of the slab through the cooling spray nozzles to 12 gf/cm$^2$ or more, setting a cooling intensity $W_1 \times t_1$ defined as a product of a cooling water density $W_1$ (L/min/m$^2$) in the first cooling zone and a time $t_1$ (min) during which the slab passes through the first cooling zone to 350 or more, setting a recuperating time $t_2$ of the slab from having passed through the first cooling zone until reaching the bent section to 0.5 min or more, and wherein a height of the vertical section is 0.5 m or more and 3.0 m or less.

2. The continuous casting method for steel according to claim 1, wherein, in the first cooling zone, the amount of water $R_1$ (L/min) per one of the cooling spray nozzles is set to 20 L/min or more and 50 L/min or less.

3. The continuous casting method for steel according to claim 1, wherein, in the first cooling zone, the cooling water density $W_1$ (L/min/m$^2$) is set to 500 L/min/m$^2$ or more and 2000 L/min/m$^2$ or less.

4. The continuous casting method for steel according to claim 1, wherein the vertical bent continuous casting device includes a second cooling zone between the first cooling zone and the bent section, and wherein, in the second cooling zone, the surface of the slab is recuperated by setting the cooling water density $W_2$ (L/min/m$^2$) to 0 L/min/m$^2$ or more and 50 L/min/m$^2$ or less.

5. The continuous casting method for steel according to claim 1, wherein the surface of the slab is recuperated after having passed through the first cooling zone and a temperature of the surface of the slab is set to a temperature of an $Ac_3$ point or higher when the slab reaches the bent section.

6. The continuous casting method for steel according to claim 1, wherein the rolls are split rolls.

* * * * *